US011794313B2

(12) United States Patent
Bessac et al.

(10) Patent No.: US 11,794,313 B2
(45) Date of Patent: Oct. 24, 2023

(54) MULTI-FUNCTION TOOL WITH LAMINATED PLIER JAWS

(71) Applicant: Fiskars Brands, Inc., Middleton, WI (US)

(72) Inventors: Grant Bessac, Beaverson, OR (US); Paul Hallbrook, Portland, OR (US); Eric Moore, Portland, OR (US); Brayden C. Johnson, Beaverton, OR (US)

(73) Assignee: FISKARS BRANDS, INC., Middleton, WI (US)

( * ) Notice: Subject to any disclaimer, the term of this patent is extended or adjusted under 35 U.S.C. 154(b) by 735 days.

(21) Appl. No.: 16/828,599

(22) Filed: Mar. 24, 2020

(65) Prior Publication Data

US 2020/0306935 A1 Oct. 1, 2020

Related U.S. Application Data

(60) Provisional application No. 62/824,122, filed on Mar. 26, 2019.

(51) Int. Cl.

| | |
|---|---|
| ***B25B 7/22*** | (2006.01) |
| ***B25B 7/02*** | (2006.01) |
| ***B26B 11/00*** | (2006.01) |

(52) U.S. Cl.

CPC ..... *B25B 7/22* (2013.01); *B25B 7/02* (2013.01); *B26B 11/001* (2013.01)

(58) Field of Classification Search

CPC ..... B25B 7/22; B25B 7/02; B26B 11/001

USPC ..... 7/132

See application file for complete search history.

(56) References Cited

U.S. PATENT DOCUMENTS

| | | | | |
|---|---|---|---|---|
| 1,585,903 | A | 5/1926 | McIntyre et al. | |
| 4,754,668 | A * | 7/1988 | Oetiker | B25B 7/04 29/268 |
| 5,595,094 | A | 1/1997 | Negus | |
| 5,697,114 | A | 12/1997 | McIntosh et al. | |
| 5,781,950 | A | 7/1998 | Swinden et al. | |
| 5,791,002 | A | 8/1998 | Gardiner et al. | |

(Continued)

OTHER PUBLICATIONS

Pictures of Craftsman multi-tool; offered for sale prior to Mar. 26, 2019, 9 pages.

(Continued)

*Primary Examiner* — Hadi Shakeri

(74) *Attorney, Agent, or Firm* — FOLEY & LARDNER LLP

(57) ABSTRACT

A multi-purpose tool includes a first handle, a second handle, and a laminated plier jaw assembly coupled to the first handle and the second handle. The laminated plier jaw assembly includes a first outer layer, a second outer layer, an inner layer, and a pin. The first outer layer defines a first aperture. The second outer layer defines a second aperture. The inner layer is positioned between and is coupled to the first outer layer and the second outer layer. The inner layer defines a slot having a narrow portion positioned between a first wide portion and a second wide portion. The pin extends at least partially through the first aperture, the second aperture, and the slot. The first outer layer, the second outer layer, and the inner layer cooperate to define a pair of jaws that rotate relative to one another about an axis of rotation.

15 Claims, 17 Drawing Sheets

(56) References Cited

U.S. PATENT DOCUMENTS 5,904,078 A * 5/1999 Gustafson ..... B25B 7/10 81/416
5,960,498 A 10/1999 Nabors et al.
5,978,993 A 11/1999 Rivera
5,996,450 A 12/1999 St. John
6,009,582 A 1/2000 Harrison et al.
6,014,787 A 1/2000 Rivera
6,047,426 A 4/2000 McIntosh et al.
6,065,376 A 5/2000 Khachatoorian
6,116,124 A 9/2000 Ping
6,145,418 A * 11/2000 Bares ..... B25B 27/146 81/421
6,216,301 B1 4/2001 Rivera
6,227,081 B1 5/2001 Bally et al.
6,243,901 B1 6/2001 Elsener et al.
6,311,588 B1 11/2001 St. John et al.
6,327,943 B1 * 12/2001 Wrigley ..... B25B 7/02 81/421
6,357,068 B1 3/2002 Seber et al.
6,408,725 B1 * 6/2002 Janson ..... B25B 7/10 81/382
6,427,565 B1 8/2002 Ping
6,430,768 B2 8/2002 McIntosh et al.
6,481,034 B2 11/2002 Elsener et al.
6,487,941 B1 12/2002 Ping
6,578,221 B2 6/2003 Ping
6,588,040 B2 7/2003 Rivera
6,718,585 B2 4/2004 McIntosh et al.
6,857,154 B2 2/2005 Rivera
6,983,505 B2 1/2006 McIntosh et al.
7,020,922 B2 4/2006 Rivera
7,028,591 B2 4/2006 Dallas et al.
D524,128 S 7/2006 Puerta
7,134,366 B2 11/2006 Schuh
7,299,724 B1 11/2007 Warheit
7,503,243 B2 3/2009 Putsch
7,762,162 B2 7/2010 Phillips et al.
7,908,944 B2 3/2011 Nason et al.
8,677,866 B2 * 3/2014 Steele ..... B25B 7/10 72/413
9,669,532 B1 6/2017 Mayer
9,676,082 B1 6/2017 Schoolland
9,682,469 B2 6/2017 Heise
9,701,004 B2 7/2017 Hardinge et al.
9,751,201 B2 9/2017 King et al.
9,770,820 B1 9/2017 Ragner
9,895,795 B2 2/2018 Nix et al.
11,583,979 B2 * 2/2023 Wang ..... B23D 21/06
2002/0083803 A1 7/2002 Ping
2010/0192735 A1 8/2010 Kelly
2016/0288309 A1 10/2016 Rauwerdink et al.
2017/0266803 A1 9/2017 Hardinge et al.
2017/0348830 A1 12/2017 Lazenby et al.
2022/0339770 A1 * 10/2022 Wiwatowski ..... B25F 1/02

OTHER PUBLICATIONS

International Search Report and Written Opinion on International Application No. PCT/IB2020/052778, dated Aug. 26, 2020, 14 pages.

* cited by examiner

MULTI-FUNCTION TOOL WITH LAMINATED PLIER JAWS

CROSS-REFERENCE TO RELATED APPLICATION

This application claims priority to U.S. Patent Application Ser. No. 62/824,122, filed Mar. 26, 2019, the content of which is hereby incorporated by reference in its entirety.

BACKGROUND

The present disclosure relates generally to the field of multi-function tools. More specifically, the present disclosure relates to folding multi-function tools including pliers. Multi-function tools typically include a pair of handles and an implement such as a wrench, pair of scissors, or pliers, along with a number of ancillary tools used to perform any number of tasks. Plier assemblies of multi-function tools typically include a pair of jaws, each of which are cast and/or machined and pinned relative to one another at a fixed point. These jaws can be costly to manufacture, and the plier assemblies are limited to manipulating items within a certain size range.

SUMMARY

At least one embodiment relates to a multi-purpose tool. The multi-purpose tool includes a first handle, a second handle, and a laminated plier jaw assembly coupled to the first handle and the second handle. The laminated plier jaw assembly includes a first outer layer, a second outer layer, an inner layer, and a pin. The first outer layer defines a first aperture. The second outer layer defines a second aperture. The inner layer is positioned between and is coupled to the first outer layer and the second outer layer. The inner layer defines a slot having a narrow portion positioned between a first wide portion and a second wide portion. The pin extends at least partially through the first aperture, the second aperture, and the slot. The first outer layer, second outer layer, and the inner layer cooperate to define a pair of jaws that rotate relative to one another about an axis of rotation. The jaws are selectively reconfigurable between a small jaw spacing configuration where the pin extends through the first wide portion of the slot and a large jaw spacing configuration where the pin extends through the second wide portion of the slot.

At least one embodiment relates to a laminated plier jaw assembly. The laminated plier jaw assembly includes a first jaw, a second jaw, and a pin. The first jaw includes a first jaw plate and a second jaw plate fixedly coupled to one another. The second jaw includes a third jaw plate and a fourth jaw plate fixedly coupled to one another. The third jaw plate and the fourth jaw plate each define a slot. The pin is fixedly coupled to the first jaw plate and extends through the slots to pivotally couple the jaws to one another. The third jaw plate is positioned between the first jaw plate and the second jaw plate, and the second jaw plate is positioned between the third jaw plate and the fourth jaw plate.

At least one embodiment relates to a laminated plier jaw assembly. The laminated plier assembly includes a first laminated jaw and a second jaw. The first laminated jaw includes a first plate defining a gripping profile and a second plate fixedly coupled to the first plate. The second plate includes a flange at least partially overhanging the first plate. The second jaw is pivotally coupled to the first laminated jaw. The first laminated jaw and the second jaw are selectively repositionable relative to one another between a fully open position and a fully closed position.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, a multi-tool includes a first handle and a second handle pivotally coupled to a plier assembly. The plier assembly includes a first jaw pivotally coupled to the second jaw. The jaws are formed with a laminated layered construction. The laminated layer construction adds rigidity and jaw torque strength beyond conventional pliers or multi-tools and also improves the crush force transmission capabilities. Specifically, the plier assembly includes a first outer layer, a first inner layer, a second inner layer, and a second outer layer. Each layer includes a series of plates that are fixedly coupled to one another using rivets to form the jaws. Each of the layers defines an aperture configured to receive a pin or rivet that pivotally couples the jaws to one another.

The first outer layer defines a chamfered slot that is configured to interface with a correspondingly shaped chamfered section of the pin. The pin is configured to rotate relative to the chamfered slot and translate along the length of the chamfered slot. The first inner layer defines an aperture that is correspondingly shaped to a flattened section of the pin. The flattened section is substantially circular except for a pair of parallel flats. The flats engage a flat portion of the aperture of the first inner layer, preventing rotation of the first inner layer relative to the pin. The second inner layer defines an hourglass slot that receives the flattened section of the pin. The hourglass slot has two wide portions with a narrow portion therebetween. The narrow portion is sized to permit passage of the pin between the wide portions when the flats of the flattened section are aligned with the narrow portion. However, the narrow portion is too narrow to permit the pin to pass through in any other orientation. When the pin is positioned in the first wide portion, the jaws are arranged in a small jaw spacing configuration. When the pin is positioned in the second wide portion, the jaws are arranged in a large jaw spacing configuration. The second outer layer defines a rivet aperture configured to receive a fixed section of the pin. The fixed section and the rivet aperture are correspondingly shaped and each define a flat surface. The flat surfaces engage one another, preventing rotation of the pin relative to the rivet aperture. Each of the outer layers define flanges that at least partially overhang the adjacent inner layers, improving the strength of the plier assembly.

Figure 1:
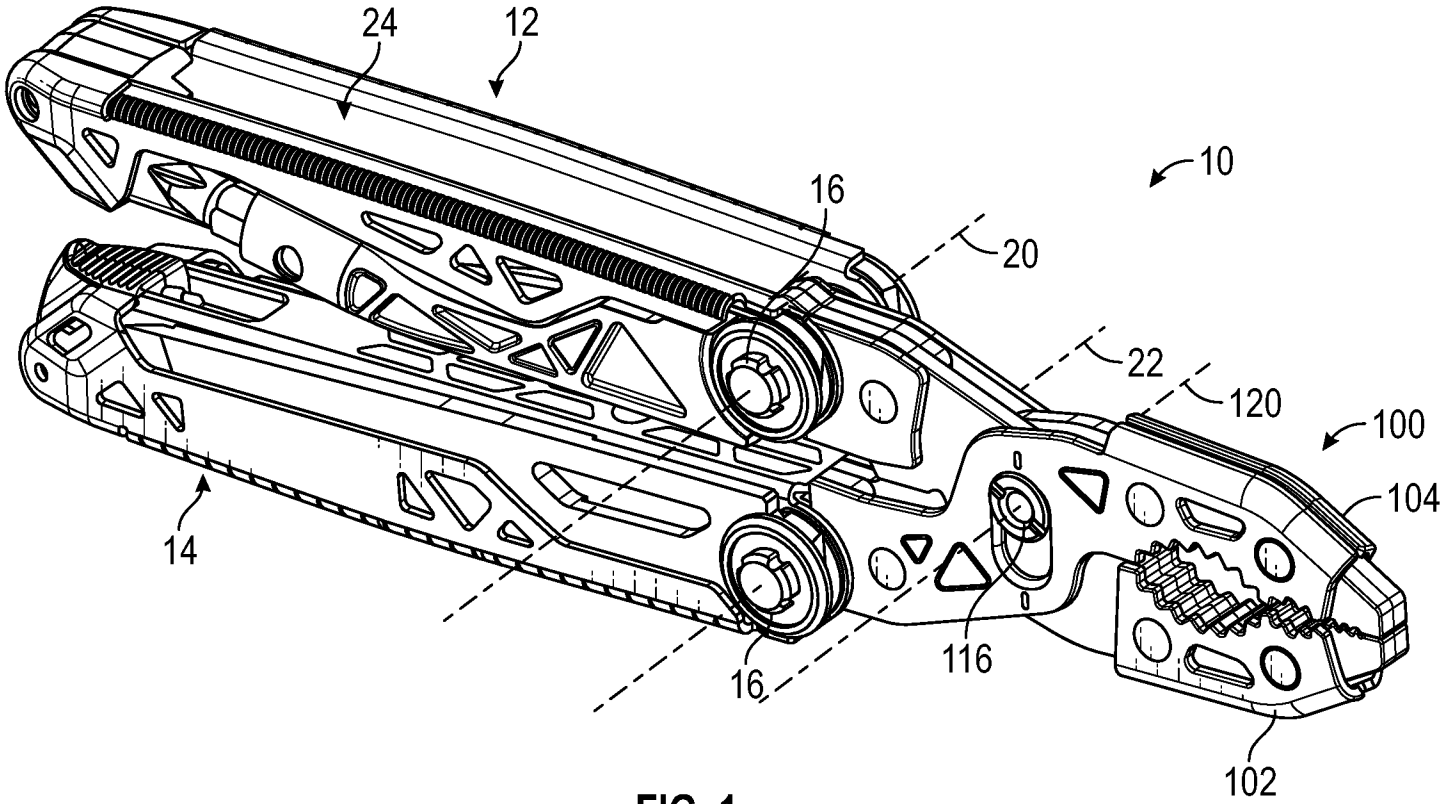
FIG. 1 is a front perspective view of a multi-tool in a working configuration, according to an exemplary embodiment.
Figure 2:
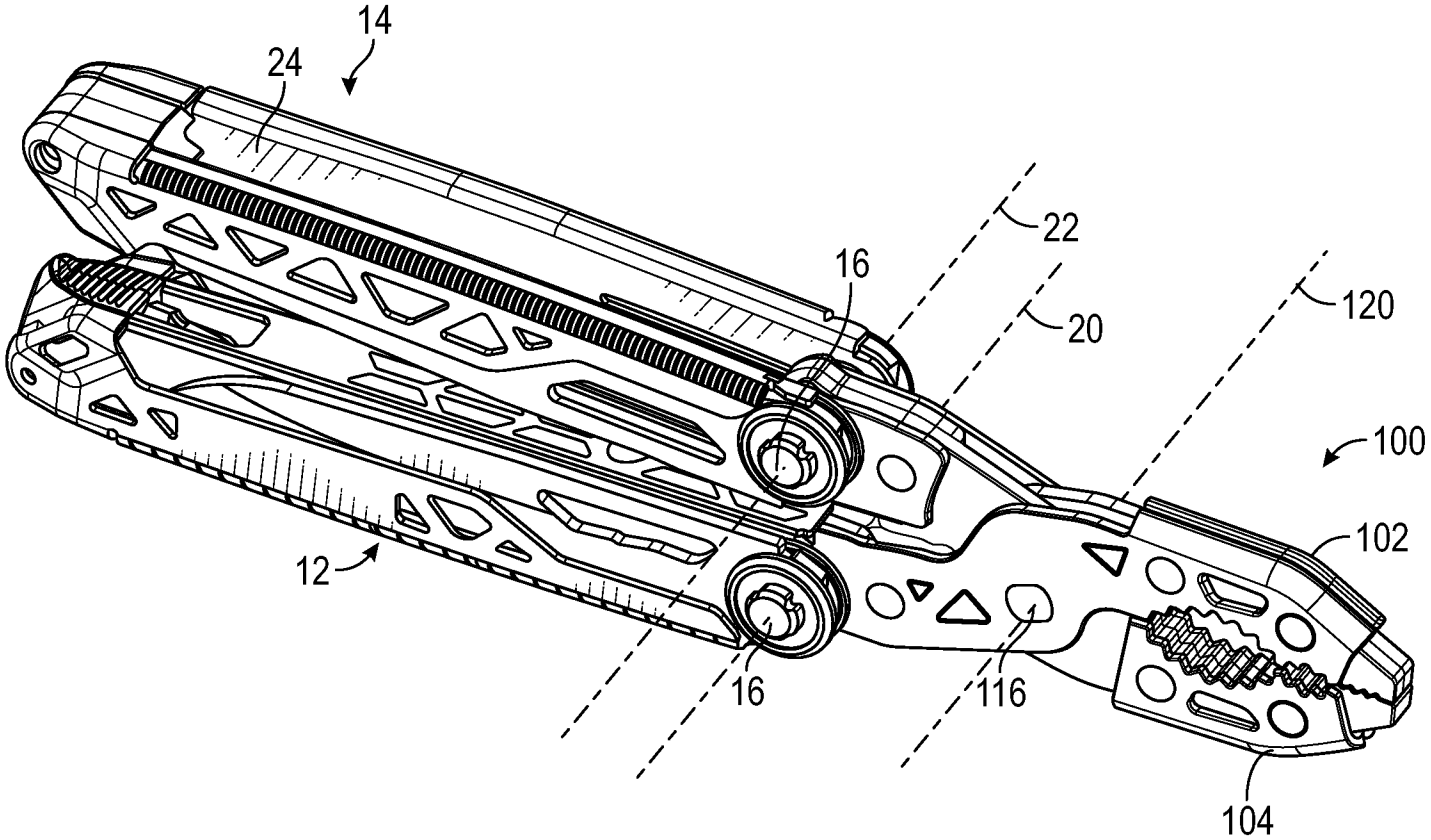
FIG. 2 is a rear perspective view of the multi-tool of FIG. 1 in the working configuration.

Referring to FIGS. 1 and 2, a multi-functional tool or foldable tool, shown as multi-tool 10, is shown according to an exemplary embodiment. The multi-tool 10 includes a first handle assembly, shown as handle 12, a second handle assembly, shown as handle 14, and a plier assembly, plier jaw assembly, primary implement, or primary tool, shown as pliers 100. The pliers 100 include a first jaw assembly, shown as jaw 102, and a second jaw assembly, shown as jaw 104. The handle 12 is pivotally coupled to the jaw 102 by a pin member 16 (e.g., a bolt, a pin, an axle, etc.), and the handle 14 is pivotally coupled to the jaw 104 by another pin member 16. The jaw 102 is pivotally coupled to the jaw 104 by a rivet 116 (e.g., a bolt, a pin, an axle, a rivet, etc.). Accordingly, the handle 12 is pivotable relative to the jaw 102 about an axis of rotation, shown as axis 20, extending through the center of the pin member 16. The handle 14 is pivotable relative to the jaw 104 about an axis of rotation, shown as axis 22, extending through the center of the other pin member 16. As such, the handles 12 and 14 are pivotally coupled to the pliers 100 in a butterfly-style arrangement. The jaw 102 is pivotable relative to the jaw 104 about an axis of rotation, shown as axis 120, extending through the center of the rivet 116. The jaw 102 and the jaw 104 are selectively repositionable relative to one another between a fully closed position (e.g., shown in FIG. 1) and a fully open position.

Figure 3:
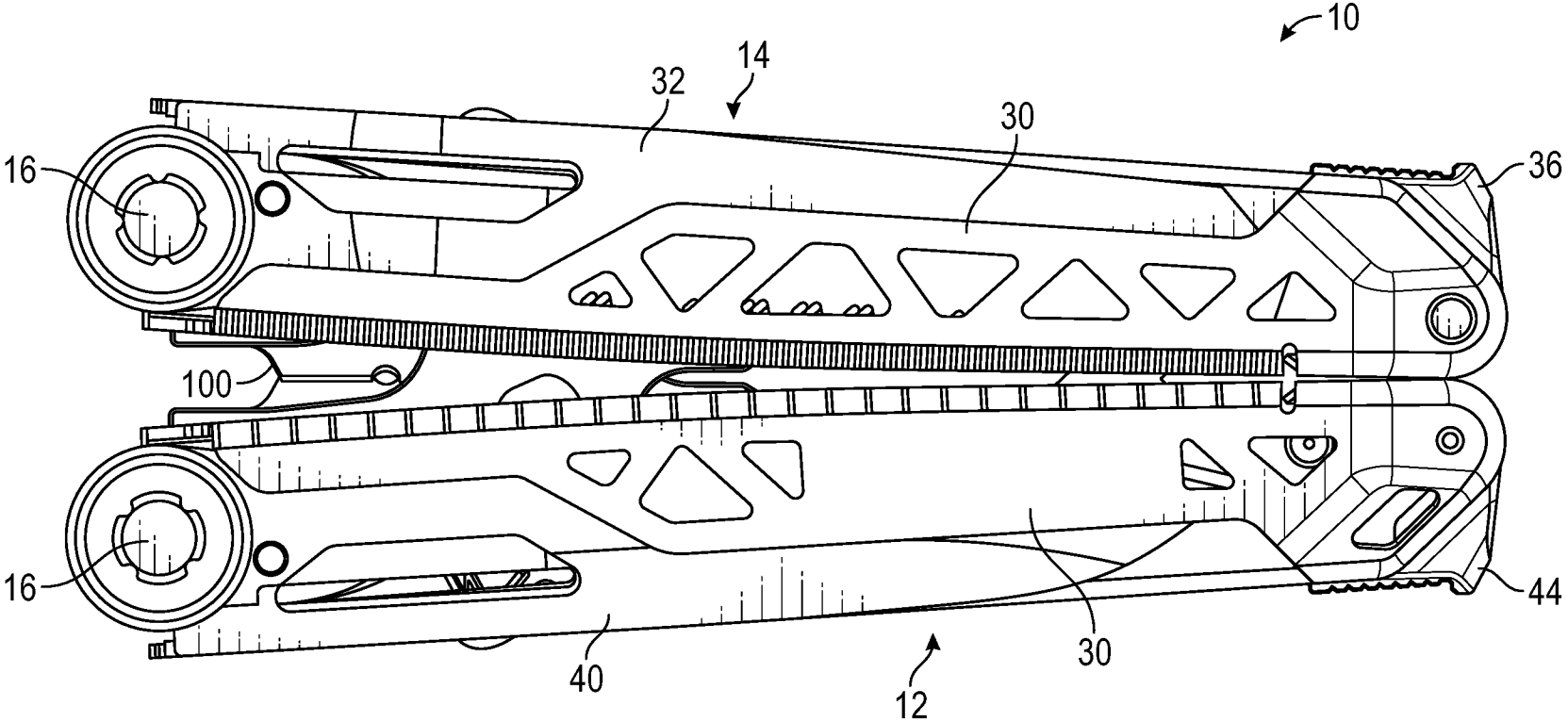
FIG. 3 is a rear view of the multi-tool of FIG. 1 in a storage configuration.

The multi-tool 10 is selectively reconfigurable between an open, use, or working configuration, shown in FIGS. 1 and 2, and a closed or storage configuration, shown in FIG. 3. In the working configuration, the handles 12 and 14 may be operated by a user to open and close the pliers 100 (e.g., to hold an object, to release an object, to cut a wire, etc.). In the storage configuration, the pliers 100 are folded into a pair of recesses 24 defined by the handles 12 and 14, reducing the overall size of the multi-tool 10.

Figure 4:
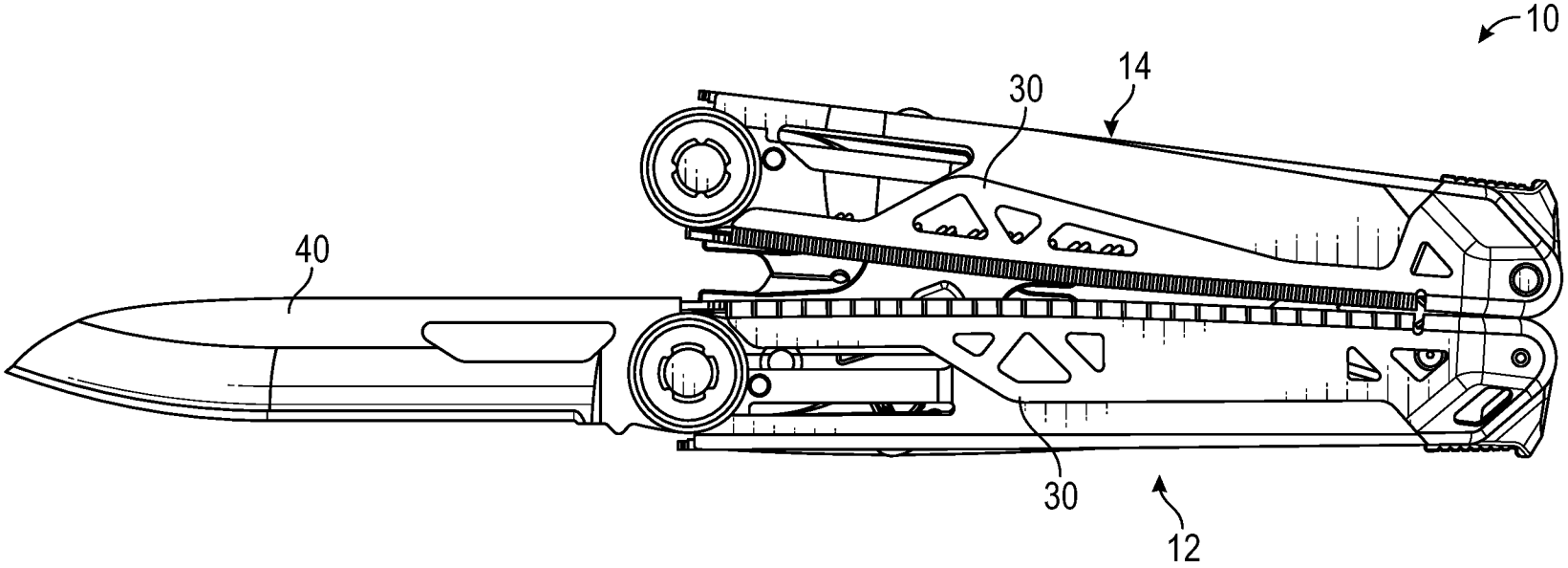
FIG. 4 is a rear view of the multi-tool of FIG. 1 in the storage configuration including a secondary tool in a working position.
Figure 5:
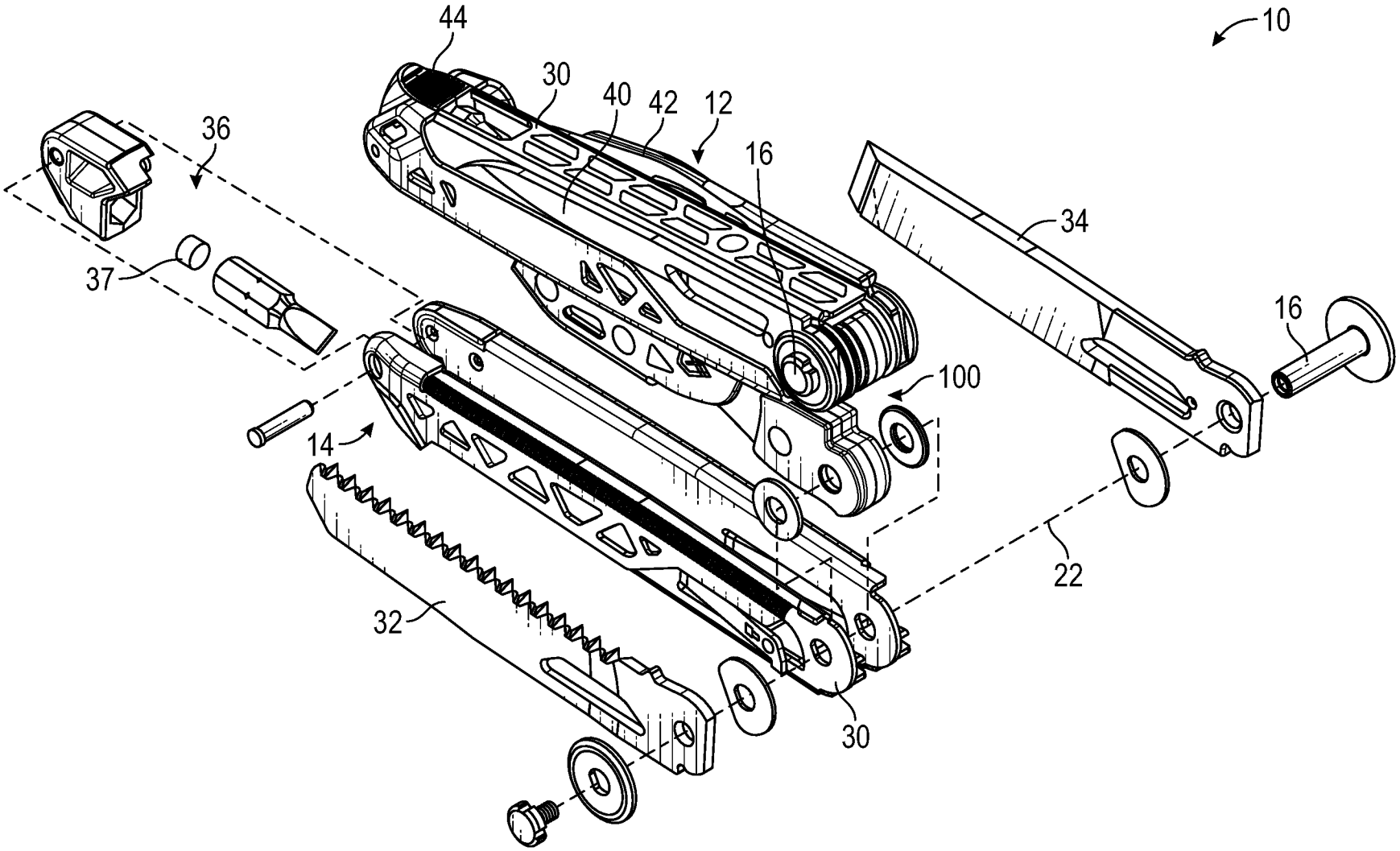
FIGS. 5 and 6 are exploded views of the multi-tool of FIG. 1.
Figure 6:
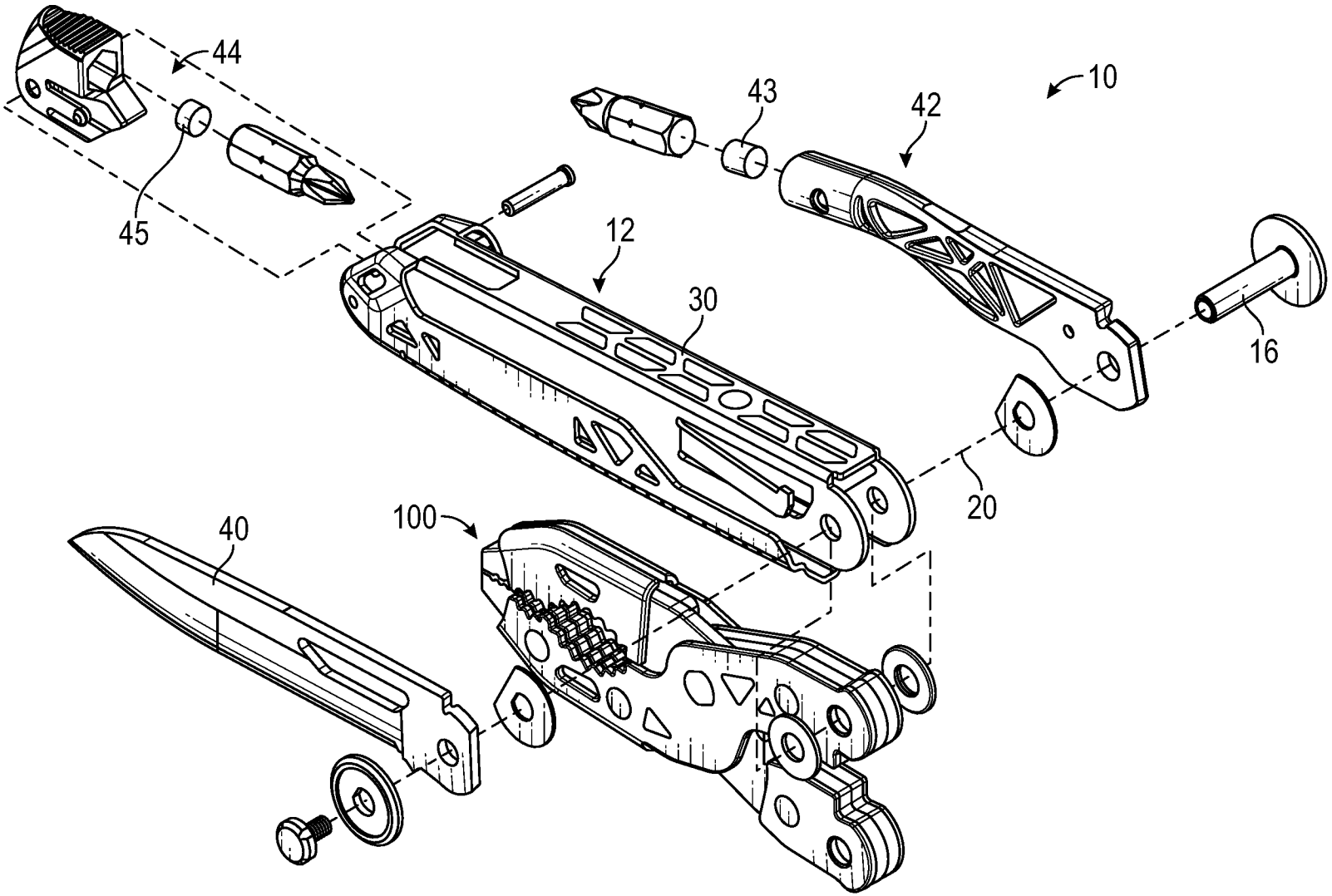

The multi-tool 10 includes a series of secondary tools that can selectively be accessed (e.g., rotated from a storage position to a working or use position) when the multi-tool 10 is in the storage configuration. Referring to FIGS. 4-6, the handle 12 and the handle 14 each include a main body or frame, shown as handle body 30. The handle 14 includes a first long secondary tool, shown as saw 32, and a second long secondary tool, shown as knife 34. The saw 32 and the knife 34 each rotate about the axis 22 and are coupled to the handle body 30 by the pin member 16. The handle 14 further includes a short secondary tool, shown as screwdriver 36. The handle 12 includes a first long secondary tool, shown as knife 40, and a second long secondary tool, shown as screwdriver 42. The knife 40 and the screwdriver 42 each rotate about the axis 20 and are coupled to the handle body 30 by the pin member 16. The handle 12 further includes a short secondary tool, shown as screwdriver 44. The screwdriver 36, the screwdriver 42, and/or the screwdriver 44 may have interchangeable bits. Accordingly, the screwdrivers 36, 42, 44 may be able to accommodate screwdriver bits of different types and sizes. Each screwdriver 36, 42, 44 can include a magnet 37, 43, 45 to facilitate a releasable coupling between the screwdriver bits and the screwdrivers 36, 42, 44.

In other embodiments, the handles 12 and 14 are slidably coupled to the pliers 100 in a sliding arrangement. Specifically, the jaw 102 may be slidably coupled to the handle 12 (e.g., translatable along a length of the handle 12) such that the jaw 102 is at least partially received within the handle 12 when the multi-tool 10 is in the stored configuration. The jaw 104 may be slidably coupled to the handle 14 (e.g., translatable along a length of the handle 14) such that the jaw 104 is at least partially received within the handle 14 when the multi-tool 10 is in the stored configuration. In such embodiments, the secondary tools (e.g., the knife 34, the screwdriver 42, the screwdriver 44, etc.) may be used regardless of whether the multi-tool 10 is in the storage configuration or the working configuration.

Figure 7:
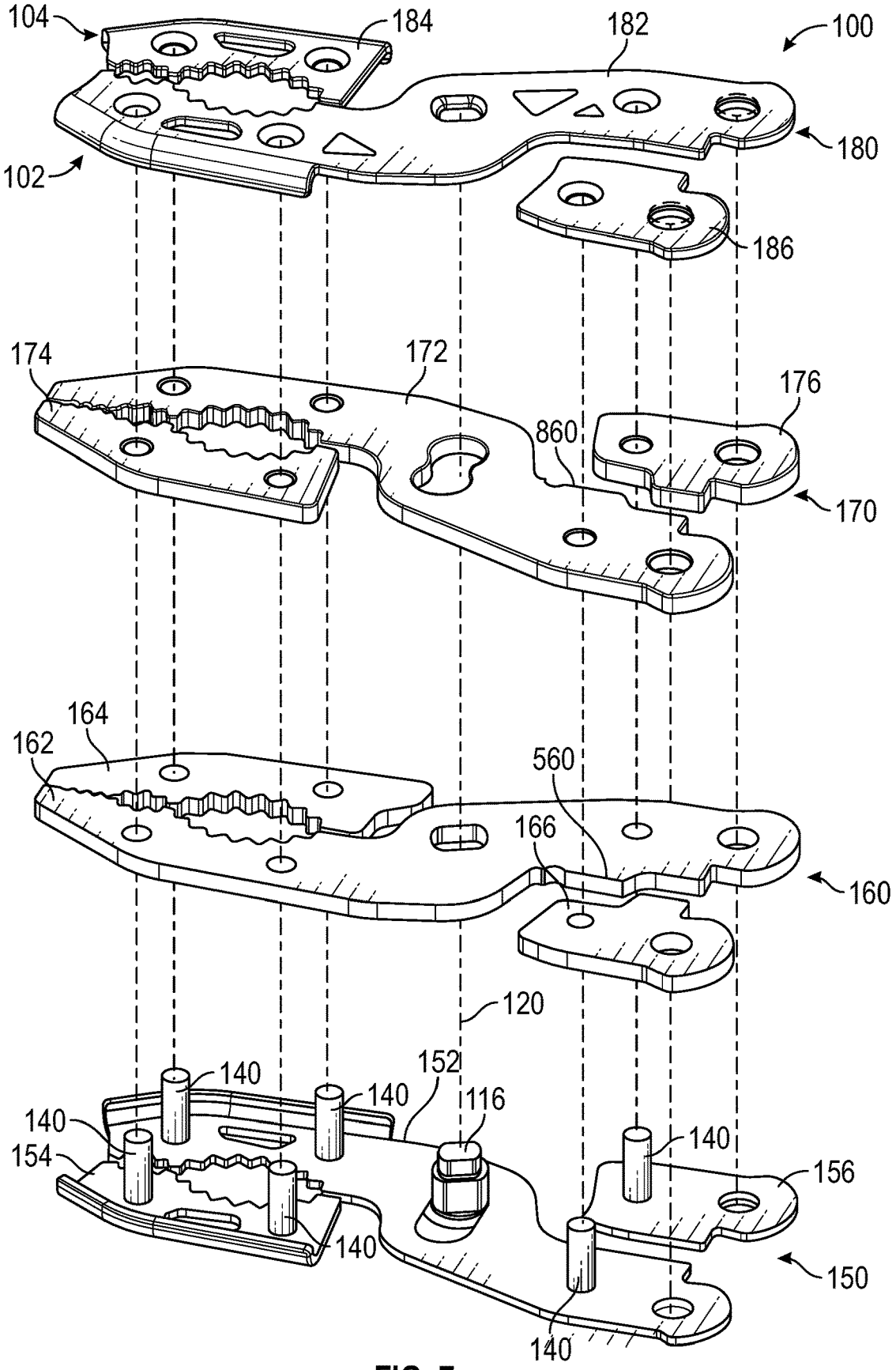
FIG. 7 is an exploded view of a plier assembly of the multi-tool of FIG. 1.

Referring to FIG. 7, the pliers 100 have a laminated construction formed from multiple plates coupled (e.g., fixedly) to one another by a series of fasteners (e.g., pins, rivets, bolts, etc.), shown as rivets 140. Specifically, the pliers 100 include a first outer layer 150, a first inner layer 160, a second inner layer 170, and a second outer layer 180, each stacked on top of one another in sequence. In some embodiments, each of the plates (i.e., the layers 150, 160, 170, 180) are substantially the same thickness. In other embodiments, the inner plates 160, 170 each have a first thickness, and the outer plates 150, 180 each have a second thickness, where the first and second thicknesses are different. The first outer layer 150 includes a main jaw plate 152, a secondary jaw plate 154, and a secondary handle plate 156.

The first inner layer 160 includes a main jaw plate 162, a secondary jaw plate 164, and a secondary handle plate 166. The second inner layer 170 includes a main jaw plate 172, a secondary jaw plate 174, and a secondary handle plate 176. The second outer layer 180 includes a main jaw plate 182, a secondary jaw plate 184, and a secondary handle plate 186. Together, the secondary jaw plate 154, the secondary handle plate 156, the main jaw plate 162, the secondary jaw plate 174, the secondary handle plate 176, the main jaw plate 182, and the corresponding rivets 140 form the jaw 102. Together, the main jaw plate 152, the secondary jaw plate 164, the secondary handle plate 166, the main jaw plate 172, the secondary jaw plate 184, the secondary handle plate 186, and the corresponding rivets 140 form the jaw 104.

In other embodiments, the pliers 100 include more layers and/or plates. By way of example, the pliers 100 may include one or more additional layers outside of the first outer layer 150 or the second outer layer 180 or between any of the layers. By way of another example, one or more of the plates described herein may be split into multiple plates. Additional plates may be coupled to the plates shown in FIG. 7 using rivets 140, adhesive, fasteners, or another type of coupling.

Figure 8:
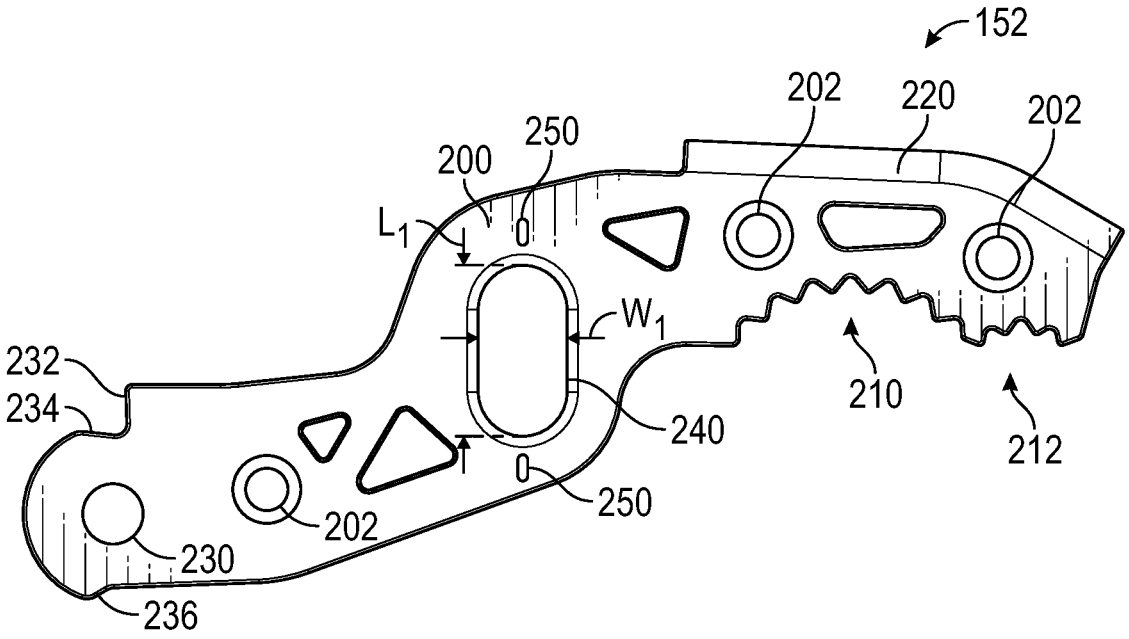
FIG. 8 is a side view of a main jaw plate of the plier assembly of FIG. 7.

Referring to FIG. 8, the main jaw plate 152 is shown according to an exemplary embodiment. The main jaw plate 152 includes a base plate, shown as plate 200, from which the main jaw plate 152 is formed. The plate 200 defines a series of apertures, shown as structural rivet apertures 202. Each structural rivet aperture 202 is configured to receive one of the rivets 140 to facilitate assembly of the pliers 100. Because the main jaw plate 152 is part of an outside layer, the structural rivet apertures 202 may be countersunk to facilitate the rivets sitting flush or near-flush with the surface of the plate 200.

The plate 200 defines a first jaw profile section or gripping profile, shown as large tooth section 210, and a second jaw profile section or gripping profile, shown as small tooth section 212. The large tooth section 210 and the small tooth section 212 each define a series of teeth arranged in an arcuate pattern. The teeth may facilitate grabbing and holding one or more items with the pliers 100. The arc about which the teeth of the large tooth section 210 are arranged is larger (e.g., has a larger radius) than the arc about which the teeth of the small tooth section 212 are arranged. This may facilitate holding items of a variety of different sizes within the pliers 100. The main jaw plate 152 includes a flange 220 extending substantially perpendicular to the plate 200. The flange 220 extends along an edge of the plate 200 and may be formed from a bent portion of the plate 200.

The plate 200 defines an aperture, shown as handle pin aperture 230. The handle pin aperture 230 is configured to receive the pin member 16 to pivotally couple the plate 200 to the corresponding handle (e.g., the handle 14). An edge of the plate 200 defines a surface, shown as stop surface 232. The stop surface 232 is positioned to engage the handle body 30 of the corresponding handle to limit or prevent travel of the handle beyond the working configuration. Arranged around the handle pin aperture 230 at approximately the same radius from the central axis of the handle pin aperture 230 (e.g., the axis 22) are a pair of substantially flat surfaces, shown as working spring surface 234 and storage spring surface 236. The working spring surface 234 and the storage spring surface 236 are configured to engage a spring (e.g., the paddle springs 1100, shown in FIG. 17) to hold the corresponding handle (e.g., the handle 14) in the working configuration and the storage configuration, respectively.

The plate 200 defines a slot, aperture, or pivot pin aperture, shown as chamfered slot 240. The chamfered slot 240 is configured to receive the rivet 116. The chamfered slot 240 has a length $L_1$ and a width $W_1$ measured perpendicular to the length $L_1$, both of which are measured perpendicular to the axis 120. The length $L_1$ is greater than the width $W_1$. The plate 200 further includes a pair of markings, shown as alignment indicators 250. The alignment indicators are arranged on opposite ends of the chamfered slot 240 and substantially aligned with the lengthwise center (e.g., positioned along the longitudinal axis) of the chamfered slot 240.

Figure 9:
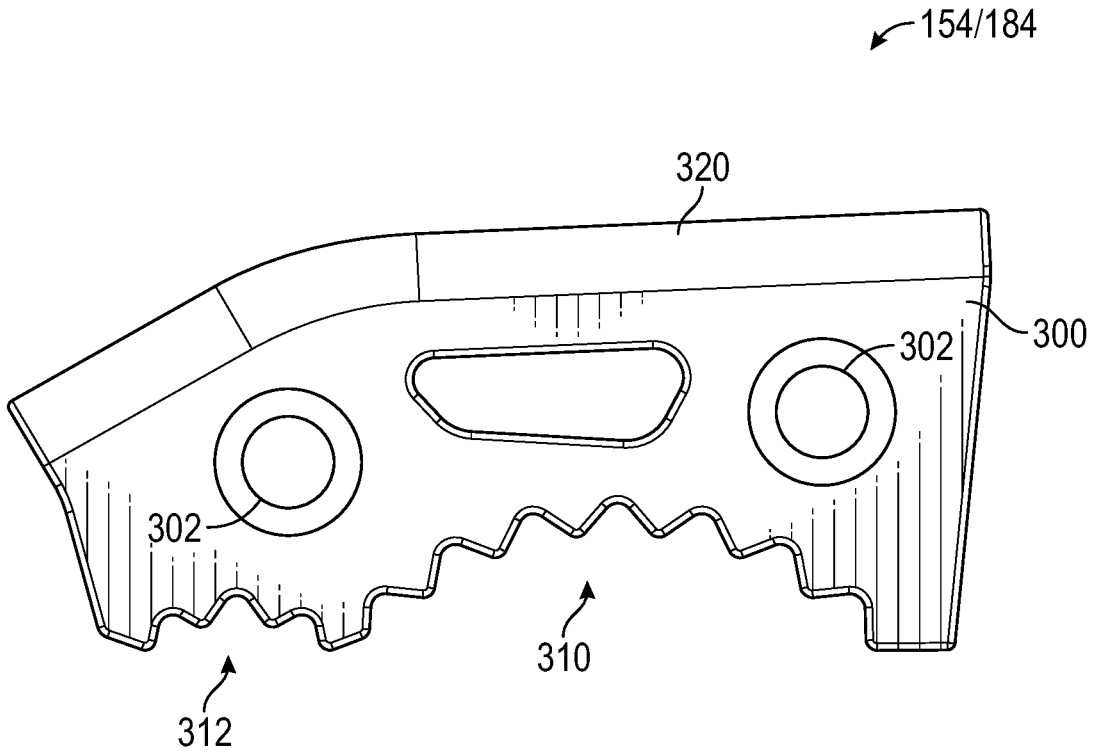
FIG. 9 is a side view of a secondary jaw plate of the plier assembly of FIG. 7.

Referring to FIG. 9, the secondary jaw plate 154 is shown according to an exemplary embodiment. The secondary jaw plate 154 and the secondary jaw plate 184 may be substantially identical. Except as otherwise specified, the secondary jaw plate 154 may be substantially similar to the main jaw plate 152. The secondary jaw plate 154 includes a plate 300. The plate 300 defines a pair of structural rivet apertures 302. The structural rivet apertures 302 may be chamfered. The plate 300 further defines a large tooth section 310 and a small tooth section 312. A flange 320 is coupled to and extends from the plate 300.

Figure 10:
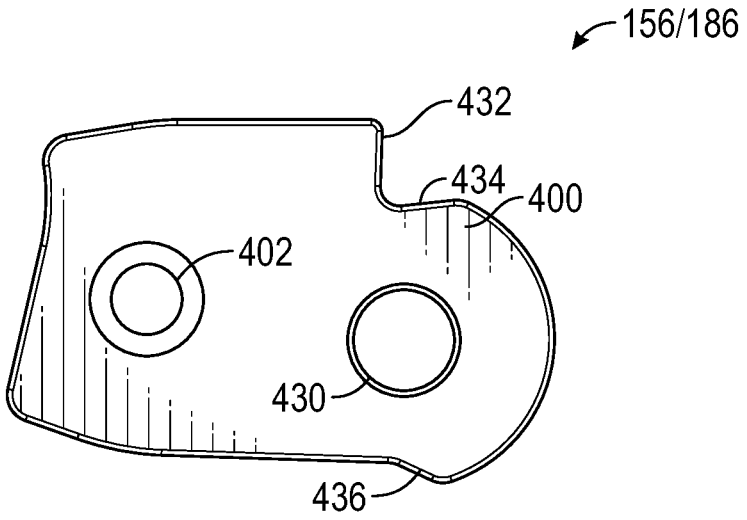
FIG. 10 is a side view of a secondary handle plate of the plier assembly of FIG. 7.

Referring to FIG. 10, the secondary handle plate 156 is shown according to an exemplary embodiment. The secondary handle plate 156 and the secondary handle plate 186 may be substantially identical. Except as otherwise specified, the secondary handle plate 156 may be substantially similar to the main jaw plate 152. The secondary handle plate 156 includes a plate 400. The plate 400 defines a structural rivet aperture 402. The structural rivet aperture 402 may be chamfered. The plate 400 further defines a handle pin aperture 430, a stop surface 432, a working spring surface 434, and a storage spring surface 436.

Figure 11:
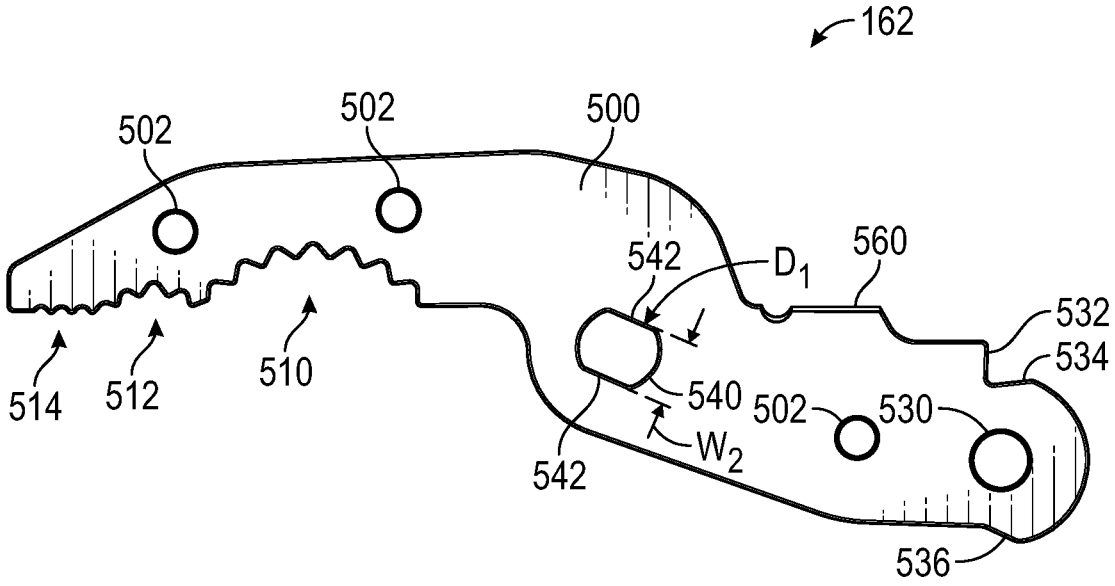
FIG. 11 is a side view of another main jaw plate of the plier assembly of FIG. 7.

Referring to FIG. 11, the main jaw plate 162 is shown according to an exemplary embodiment. Except as otherwise specified, the main jaw plate 162 may be substantially similar to the main jaw plate 152. The main jaw plate 162 includes a plate 500. The plate 500 defines a series of structural rivet apertures 502. The structural rivet apertures 502 may not be chamfered. The plate 500 defines a large tooth section 510 and a small tooth section 512. The plate 500 further defines a gripping profile, shown as flat tooth section 514. The flat tooth section 514 includes a series of teeth that extend along a substantially straight line. In some embodiments, the flat tooth section 514 engages a flat tooth section of another plate of the pliers 100 when the pliers 100 are fully closed. As shown in FIGS. 1 and 7, the portion of the plate 500 that defines the flat tooth section 514 extends beyond the first and second outer layers 150 and 180.

The plate 500 defines a handle pin aperture 530, a stop surface 532, a working spring surface 534, and a storage spring surface 536. The plate 500 defines an aperture 540 configured to receive the rivet 116. The aperture 540 has two substantially flat portions, shown as flats 542. The flats 542 extend substantially parallel to one another. The flats 542 are offset from one another by a width $W_2$. The remainder of the aperture 540 is substantially circular and has a diameter $D_1$. An edge of the plate 500 opposite the tooth sections is sharpened to define a blade 560. The blade 560 cooperates with a blade of another plate to form a cutter.

Figure 12:
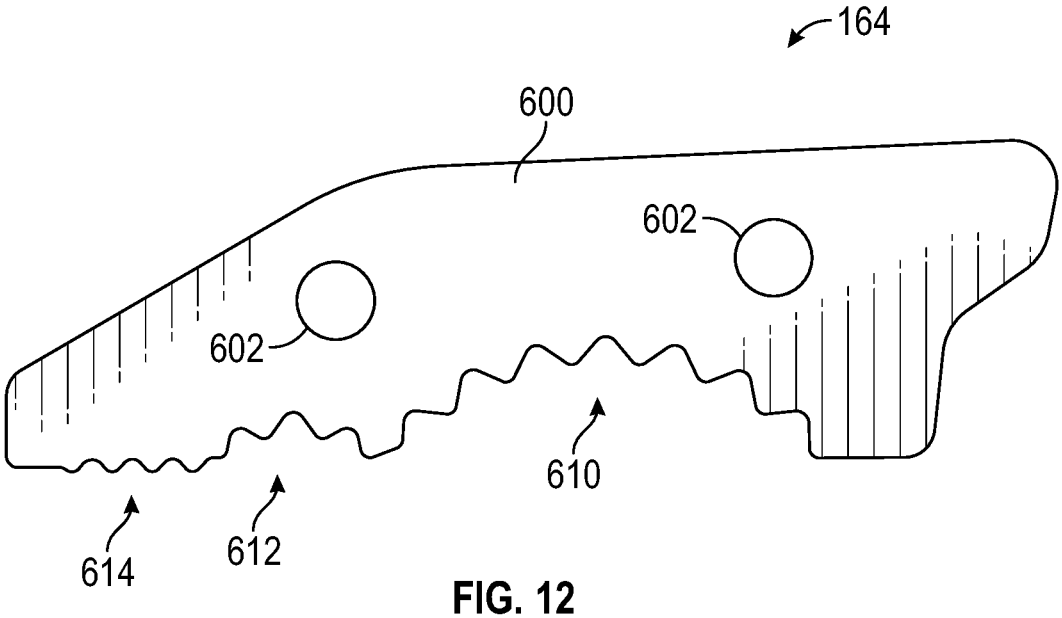
FIG. 12 is a side view of another secondary jaw plate of the plier assembly of FIG. 7.

Referring to FIG. 12, the secondary jaw plate 164 is shown according to an exemplary embodiment. Except as otherwise specified, the secondary jaw plate 164 may be substantially similar to the main jaw plate 162. The secondary jaw plate 164 includes a plate 600. The plate 600 defines a pair of structural rivet apertures 602. The structural rivet apertures 602 may not be chamfered. The plate 600 further defines a large tooth section 610, a small tooth section 612, and a flat tooth section 614.

Figure 13:
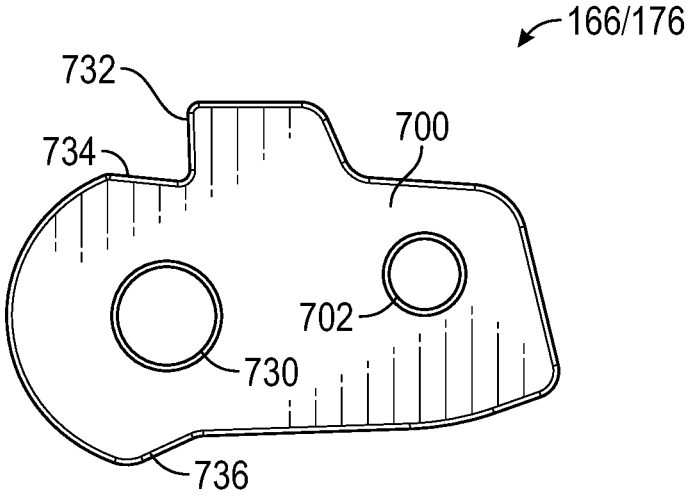
FIG. 13 is a side view of another secondary handle plate of the plier assembly of FIG. 7.

Referring to FIG. 13, the secondary handle plate 166 is shown according to an exemplary embodiment. The secondary handle plate 166 and the secondary handle plate 176 may be substantially identical. Except as otherwise specified, the secondary handle plate 166 may be substantially similar to the main jaw plate 152. The secondary handle plate 166 includes a plate 700. The plate 700 defines a structural rivet aperture 702. The structural rivet aperture 702 may not be chamfered. The plate 700 further defines a handle pin aperture 730, a stop surface 732, a working spring surface 734, and a storage spring surface 736.

Figure 14:
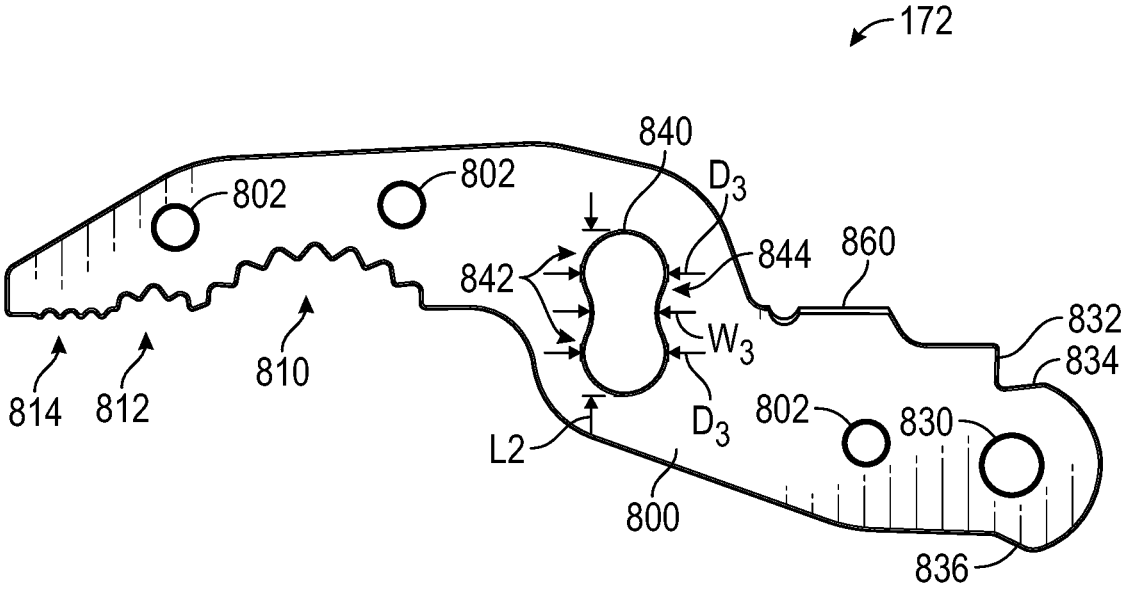
FIG. 14 is a side view of another main jaw plate of the plier assembly of FIG. 7.

Referring to FIG. 14, the main jaw plate 172 is shown according to an exemplary embodiment. Except as otherwise specified, the main jaw plate 172 may be substantially similar to the main jaw plate 162. The main jaw plate 172 includes a plate 800. The plate 800 defines a series of structural rivet apertures 802. The structural rivet apertures 802 may not be chamfered. The plate 800 defines a large tooth section 810, a small tooth section 812, and a flat tooth section 814. The plate 800 defines a handle pin aperture 830, a stop surface 832, a working spring surface 834, and a storage spring surface 836.

The plate 800 defines an aperture or slot, shown as hourglass slot 840, having an hourglass or figure-eight profile. The hourglass slot 840 is configured to receive the rivet 116. The hourglass slot 840 has two wide portions 842. The wide portions 842 are positioned on opposite sides of a neck portion or section, shown as narrow portion 844. The wide portions 842 are substantially circular and each have a diameter $D_2$. The narrow portion 844 has a width $W_3$ at its narrowest point. The hourglass slot 840 has a length $L_2$. In some embodiments, the length $L_2$ is approximately equal to the length $L_1$ of the chamfered slot 240. The plate 800 further defines a blade 560.

Figure 15:
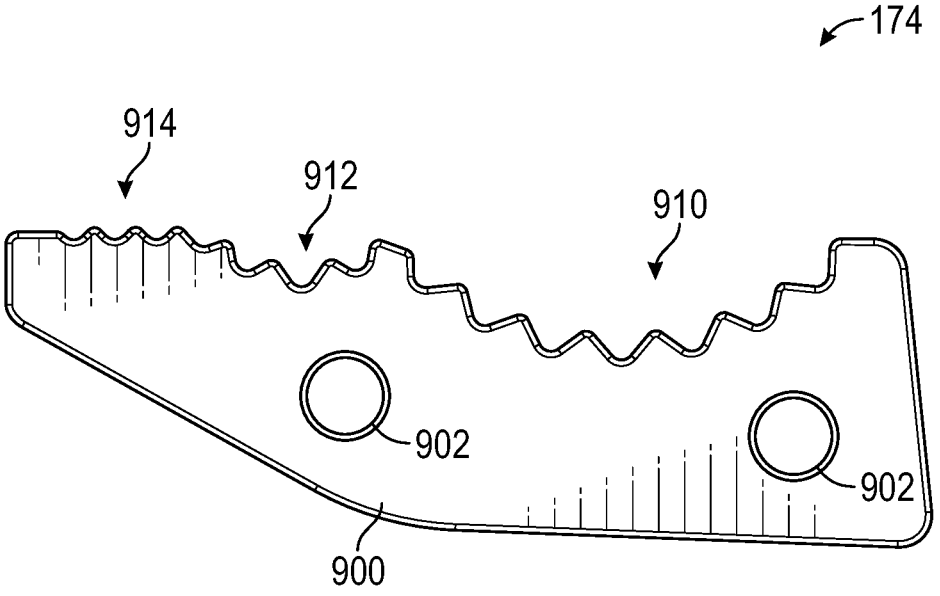
FIG. 15 is a side view of another secondary jaw plate of the plier assembly of FIG. 7.

Referring to FIG. 15, the secondary jaw plate 174 is shown according to an exemplary embodiment. Except as otherwise specified, the secondary jaw plate 174 may be substantially similar to the main jaw plate 162. The secondary jaw plate 174 includes a plate 900. The plate 900 defines a pair of structural rivet apertures 902. The structural rivet apertures 902 may not be chamfered. The plate 900 further defines a large tooth section 910, a small tooth section 912, and a flat tooth section 914.

Figure 16:
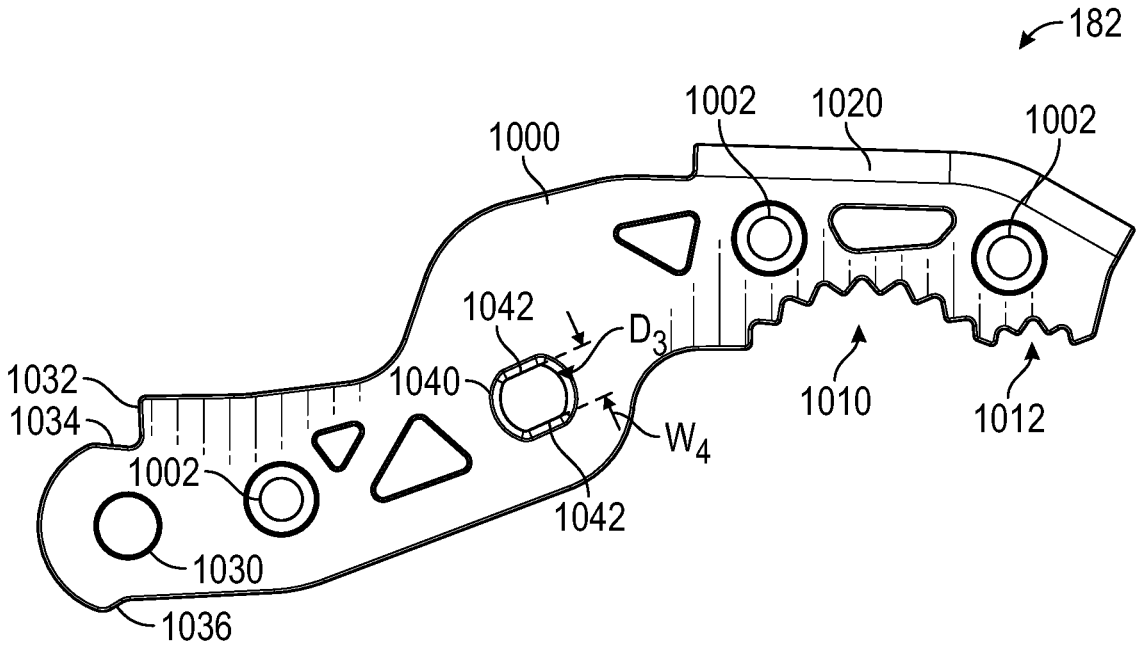
FIG. 16 is a side view of another main jaw plate of the plier assembly of FIG. 7.

Referring to FIG. 16, the main jaw plate 182 is shown according to an exemplary embodiment. Except as otherwise specified, the main jaw plate 182 may be substantially similar to the main jaw plate 152. The main jaw plate 182 includes a plate 1000. The plate 1000 defines a series of structural rivet apertures 1002. The structural rivet apertures 1002 may be chamfered. The plate 1000 defines a large tooth section 1010 and a small tooth section 1012. A flange 1020 is coupled to and extends from the plate 1000. The plate 1000 defines a handle pin aperture 1030, a stop surface 1032, a working spring surface 1034, and a storage spring surface 1036. The plate 1000 defines a rivet fixing aperture or fixed connection aperture, shown as chamfered aperture 1040, configured to receive the rivet 116. The chamfered aperture 1040 has two substantially flat portions, shown as flats 1042. The flats 1042 extend substantially parallel to one another. The flats 1042 are offset from one another by a width $W_4$. The remainder of the chamfered aperture 1040 is substantially circular and has a diameter of $D_3$. In some embodiments, the width $W_4$ and the diameter $D_3$ are smaller than the width $W_2$ and the diameter $D_1$ of the aperture 540, respectively.

Figure 17:
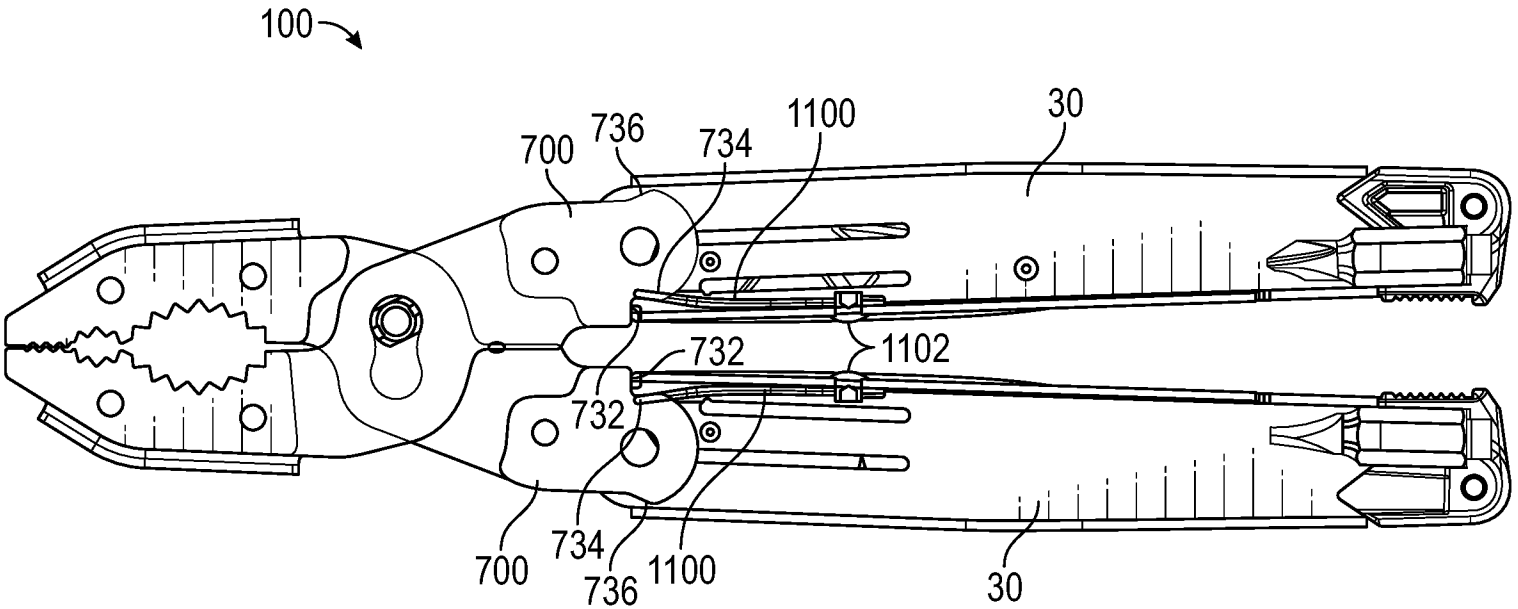
FIG. 17 is a side section view of the multi-tool of FIG. 1 in the working configuration.

Referring to FIG. 17, the multi-tool 10 is shown in the working configuration. A pair of cantilevered biasing members, shown as paddle springs 1100, are coupled to the handle bodies 30. Specifically, a first end of each paddle spring 1100 is coupled to the handle body 30 by a fastener, shown as rivet 1102. A second end of each paddle spring 1100 opposite the first end is biased to engage the corresponding jaw. When the handle is in the working configuration, the paddle spring 1100 engages the working spring surfaces of the corresponding plates. Because the paddle spring 1100 and the working spring surfaces are both flat, the biasing force of the paddle spring 1100 opposes motion of the handle toward the storage configuration. If the biasing force is overcome, the paddle spring 1100 then engages a circular surface extending between the working spring surfaces and the storage spring surfaces. Once the handle reaches the storage configuration, the paddle spring 1100 engages the storage spring surface, and the biasing force opposes movement out of the storage configuration.

Referring to FIGS. 18-21, the rivet 116 includes multiple different sections, each configured to interact with a different one of the main jaw plates. A first section, shown as base chamfer section 1200, is configured to be received within the chamfered slot 240. The chamfer of the base chamfer section 1200 matches the chamfer of the chamfered slot 240 such that the rivet 116 can translate freely along the length $L_1$ of the chamfered slot 240 and rotate freely about the axis 120 relative to the main jaw plate 152.

A second section, shown as flattened section 1210, is configured to be received within the aperture 540 and within the hourglass slot 840. The flattened section 1210 has two substantially flat surfaces, shown as flats 1212. The flats 1212 are substantially parallel to one another and offset from one another by a width $W_5$. The remainder of the flattened section 1210 is substantially cylindrical and has a diameter $D_4$. The width $W_5$ and the diameter $D_4$ of the flattened section 1210 are substantially equal to the width $W_2$ and the diameter $D_1$ of the aperture 540. Accordingly, due to interference between the flats 1212 and the flats 542, rotation of the main jaw plate 162 relative to the rivet 116 is prevented. As described with respect to FIGS. 22 and 23, the geometry of the flattened section 1210 also interacts with the hourglass slot 840 to permit selective translation of the jaw 104 relative to the rivet 116.

A third section of the rivet 116, shown as fixed section, closure section, or rivet section 1220, is configured to be received within the chamfered aperture 1040. The rivet section 1220 has two substantially flat surfaces, shown as flats 1222. The flats 1222 are substantially parallel to one another and offset from one another by a width $W_6$. The remainder of the rivet section 1220 is substantially cylindrical and has a diameter $D_5$. The width $W_6$ and the diameter $D_5$ of the rivet section 1220 are substantially equal to the width $W_4$ and the diameter $D_3$ of the chamfered aperture 1040, respectively. Accordingly, due to interference between the flats 1222 and the flats 1042, rotation of the main jaw plate 182 relative to the rivet 116 is limited (e.g., prevented).

Figure 18:
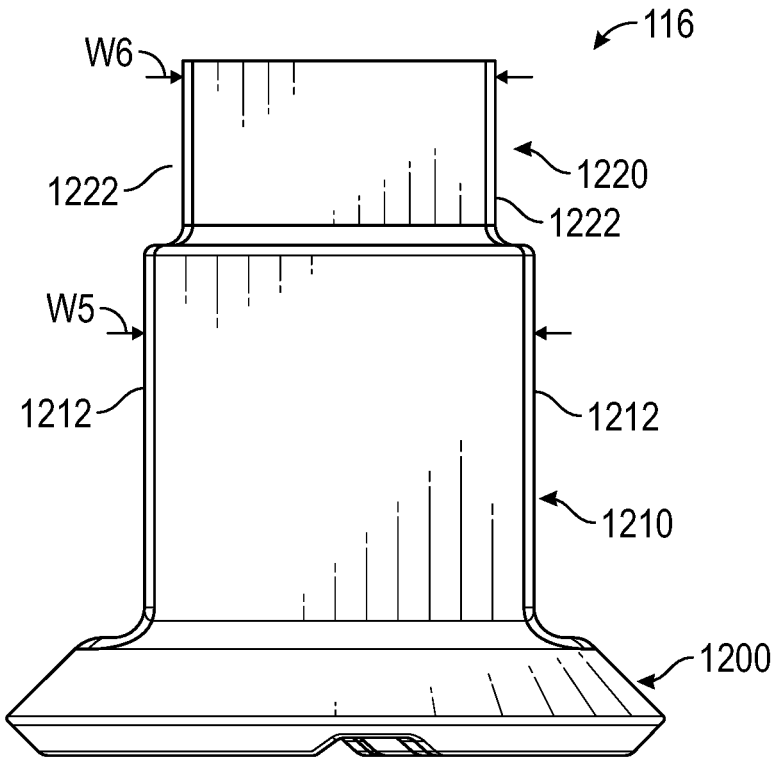
FIG. 18 is a front view of a rivet of the plier assembly of FIG. 7 in an uninstalled configuration.
Figure 19:
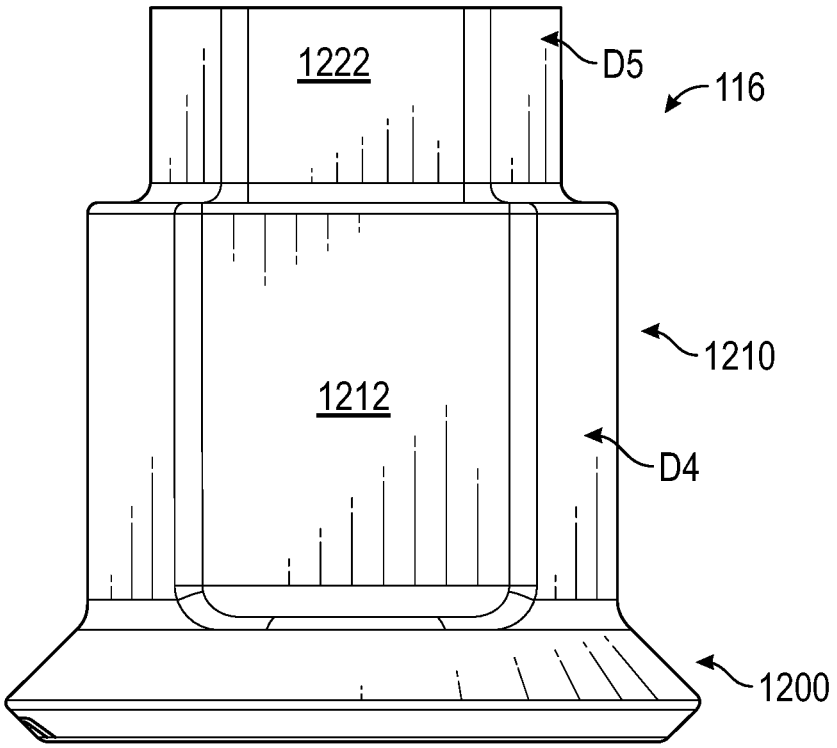
FIG. 19 is a right side view of the rivet of FIG. 18 in the uninstalled configuration.
Figure 20:
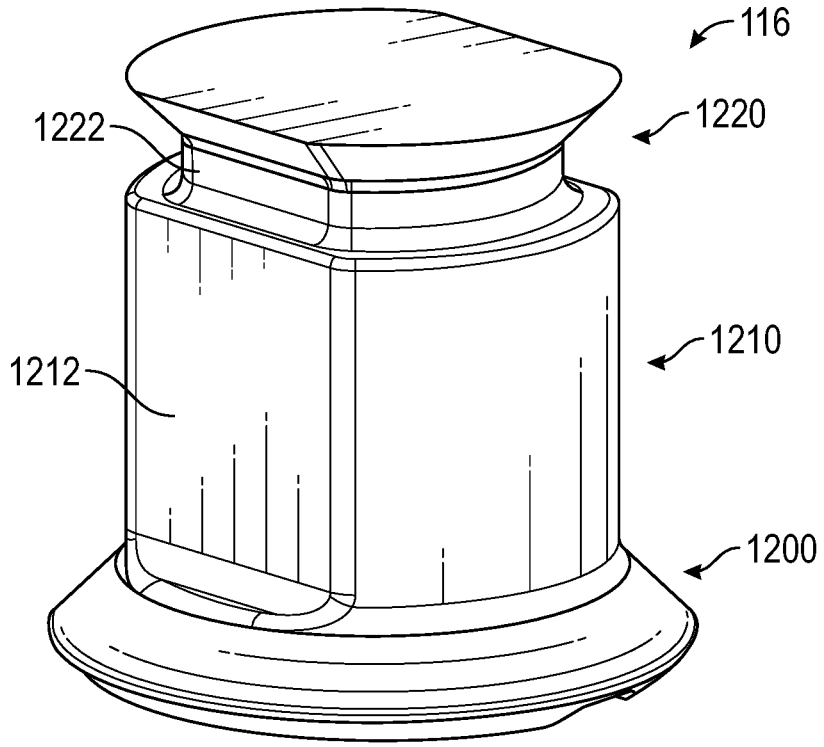
FIG. 20 is a top perspective view of the rivet of FIG. 18 in an installed configuration.
Figure 21:
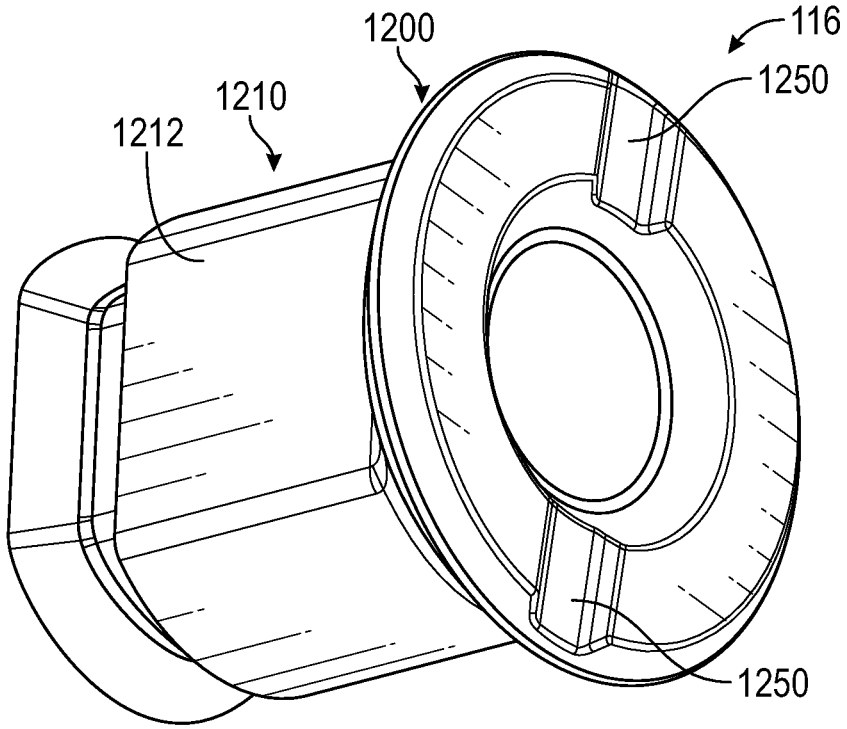
FIG. 21 is a bottom perspective view of the rivet of FIG. 18 in the installed configuration.

FIGS. 18 and 19 illustrate the rivet 116 in an uninstalled configuration. FIGS. 20 and 21 illustrate the rivet 116 in an installed configuration. To install the rivet 116, the rivet 116 is inserted through the chamfered slot 240, the aperture 540, the hourglass slot 840, and the chamfered aperture 1040. The rivet 116 is then compressed such that the rivet section 1220 deforms to match the chamfer of the chamfered aperture 1040. The opposing chamfers of the base chamfer section 1200 and the rivet section 1220 prevent the rivet 116 from being removed from the pliers 100.

Figure 22:
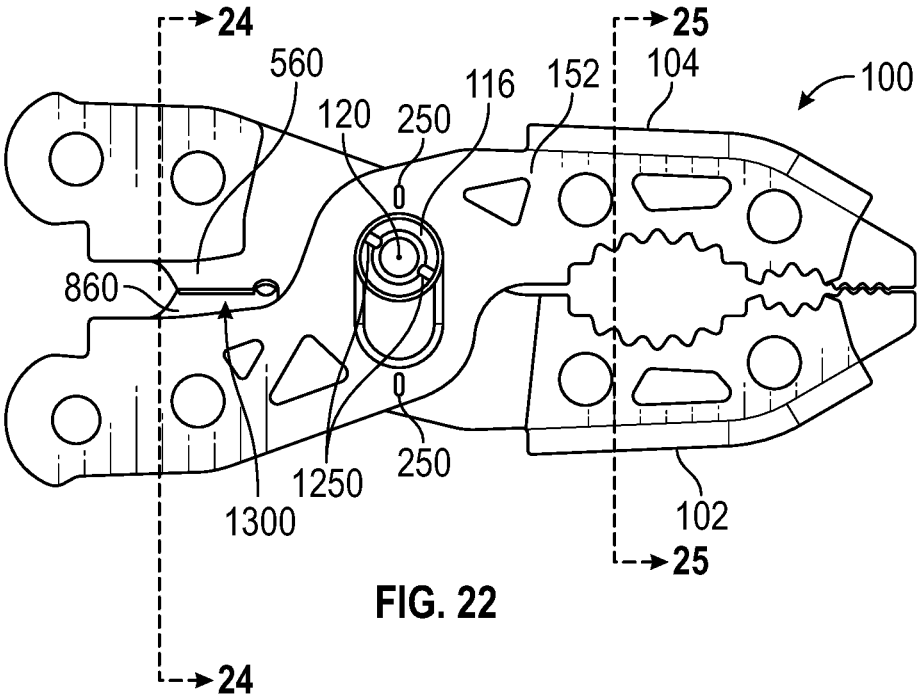
FIG. 22 is a side view of the plier assembly of FIG. 7 in a small jaw spacing configuration, according to an exemplary embodiment.
Figure 23:
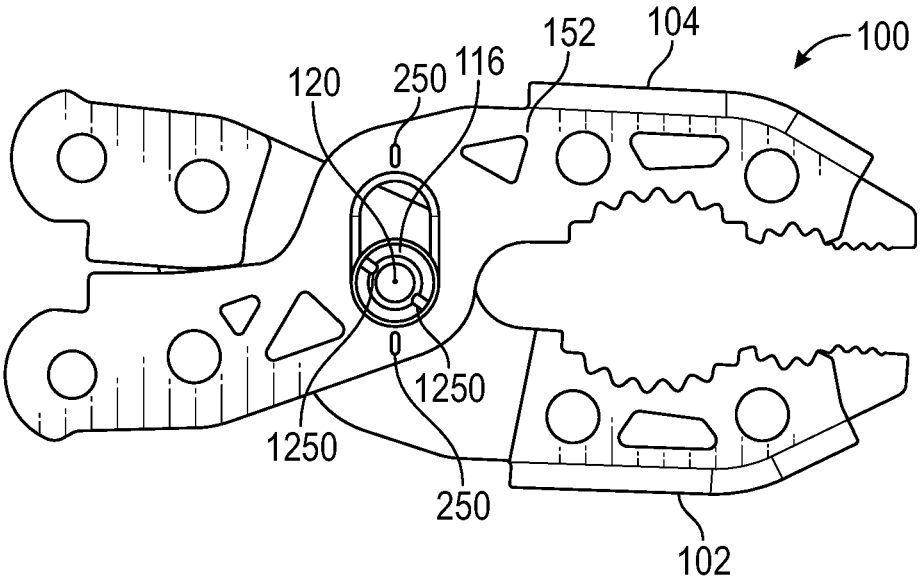
FIG. 23 is a side view of the plier assembly of FIG. 7 in a large jaw spacing configuration, according to an exemplary embodiment.
Figure 25:
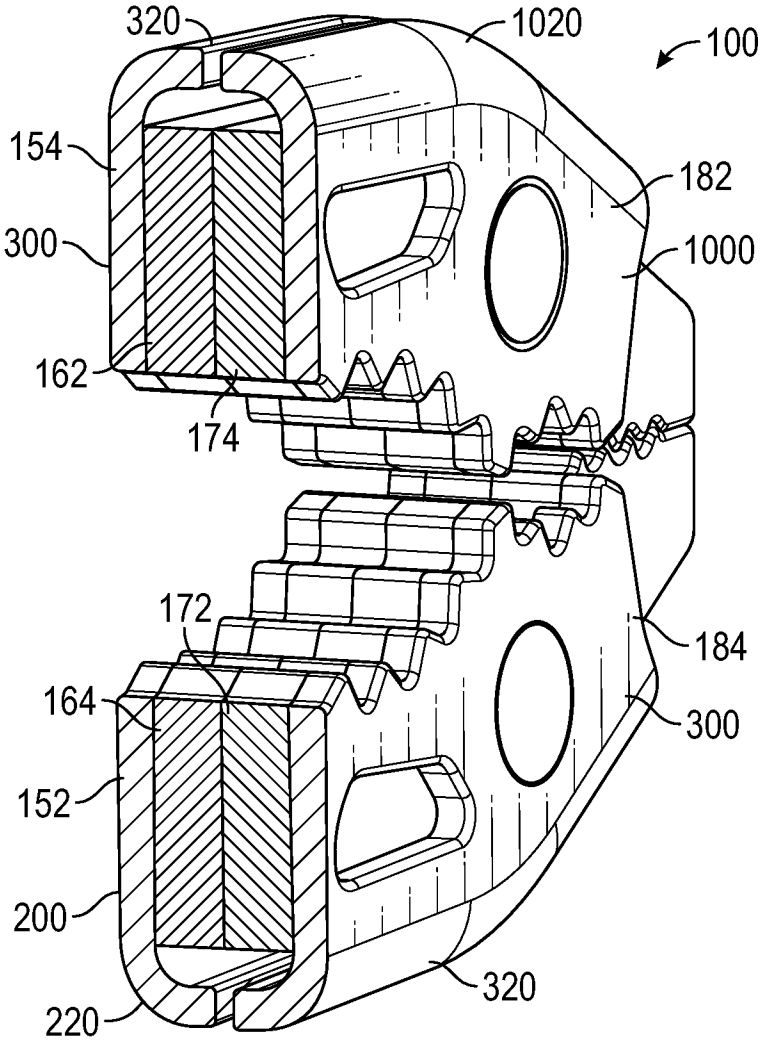
FIG. 25 is a perspective cross-sectional view of the plier assembly of FIG. 22, taken along lines 25-25 shown in FIG. 22.
Figure 24:
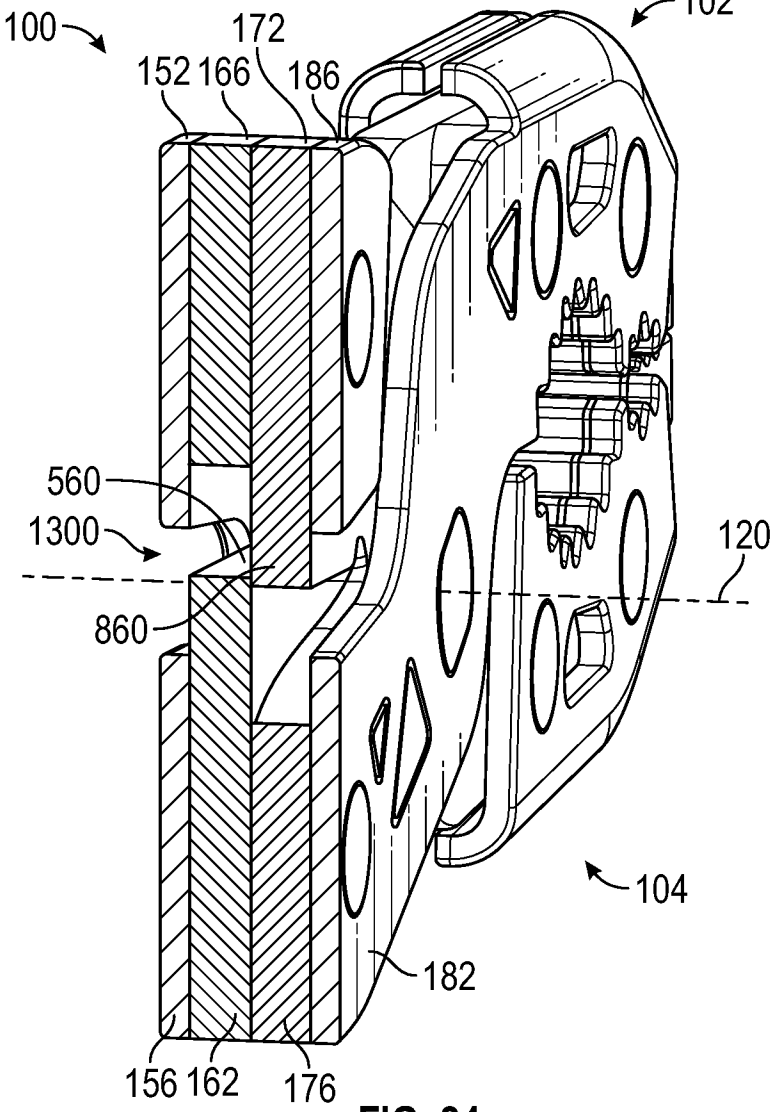
FIG. 24 is a perspective cross-sectional view of the plier assembly of FIG. 22, taken along lines 24-24 shown in FIG. 22.

Referring to FIGS. 22 and 23, the pliers 100 are selectively reconfigurable between a small jaw spacing configuration, shown in FIG. 22, and a large jaw spacing configuration, shown in FIG. 23. In the small jaw spacing configuration, the flat tooth sections of the jaws engage one another when the pliers 100 are closed. In the large jaw spacing configuration, the flat tooth sections of the jaws are offset from one another when the pliers 100 are closed. Accordingly, the small jaw spacing configuration may be useful for grasping small items, whereas the large jaw spacing configuration may be useful for grasping large items.

Referring to FIGS. 14 and 18-23, the pliers 100 are selectively reconfigurable between the small jaw spacing configuration and the large jaw spacing configuration depending upon the position and orientation of the flattened section 1210 of the rivet 116 relative to the hourglass slot 840 of the main jaw plate 172. The pliers 100 are in the small jaw spacing configuration when the rivet 116 is centered within one of the wide portions 842 of the hourglass slot 840 (e.g., the top wide portion 842 as shown in FIG. 14). The pliers 100 are in the large jaw spacing configuration when the rivet 116 is centered within the other wide portion 842 of the hourglass slot 840 (e.g., the bottom wide portion 842 as shown in FIG. 14).

The diameter $D_4$ of the flattened section 1210 is slightly smaller than the diameter $D_3$ of the wide portions 842 of the hourglass slot 840. Accordingly, the main jaw plate 172 (and thus the jaw 104) is free to rotate relative to the rivet 116 (e.g., about the axis 120) when the flattened section 1210 is centered within either of the wide portions 842. The diameter $D_3$ and the diameter $D_4$ may be similarly sized to limit slop (e.g., translation of the jaws 102 and 104 perpendicular to the axis 120) in these configurations. The width $W_3$ of the narrow portion 844 is smaller than the diameter $D_4$ of the flattened section 1210. This prevents the flattened section 1210 from moving away from the center of each wide portion 842. To move the flattened section 1210 between the wide portions 842, the main jaw plate 172 can be rotated relative to the rivet 116 until the flats 1212 align with the narrow portion 844. The width $W_5$ between the flats 1212 is less than the width $W_3$ of the narrow portion 844, permitting free translation of the rivet 116 along the length $L_2$ of the hourglass slot 840 when the flats 1212 are parallel to the length $L_2$.

The flats 1212 and the hourglass slot 840 may be oriented relative to one another such that the flats 1212 align with the narrow portion 844 when the pliers 100 are outside of a normal range of motion (e.g., are in a fully open position, are in a wide open position, etc.). This may minimize the potential for unintentionally reconfiguring the pliers 100 between the small and large jaw spacing configurations during normal operation (e.g., one handed operation) of the pliers 100. To facilitate determining when the flats 1212 are aligned with the narrow portion 844, the rivet 116 defines a pair of markings (e.g., indentations, bosses, printed indicators, etc.) shown as alignment indicators 1250. In other embodiments, the rivet 116 defines more or fewer alignment indicators 1250. The alignment indicators 1250 are oriented such that the flats 1212 are aligned with the narrow portion 844 when the alignment indicators 1250 are aligned with the alignment indicators 250 of the main jaw plate 152. Accordingly, the alignment indicators 250 and the alignment indicators 1250 facilitate fast, visual determination of the orientation of the flats 1212, which would otherwise be obscured from view.

Referring to FIGS. 7, 11, 14, 22, and 24, the blade 560 of the main jaw plate 162 and the blade 860 of the main jaw plate 172 cooperate to form a cutter (e.g., a scissor, a wire cutter, a wire stripper, etc.), shown as wire cutter 1300. With the pliers 100 in the small jaw spacing configuration and in a fully closed position, the blade 560 overlaps and is positioned adjacent to the blade 860. The blade 560 and the blade 860 are formed from adjacent inner layers of the laminated construction, minimizing a spacing between the blade 560 and the blade 860 (e.g., as measured parallel to the axis 120). Accordingly, when the pliers 100 are moved toward the fully closed position, the sharpened edges of the blade 560 and the blade 860 perform a cleaving motion, cutting anything present within the path of the wire cutter 1300. A distance from the handles 12 and 14 to the axis 120 is greater than a distance from the wire cutters 1300 to the axis 120. This provides an increased mechanical advantage to the user, facilitating cutting of thick or hard items with the wire cutter 1300. In other embodiments, the wire cutters 1300 have a different profile (e.g., a circular profile) to facilitate different cutting tasks (e.g., stripping wires).

Referring to FIGS. 7-9, 16, 17, and 25, the flanges 220, 320, and 1020 increase the strength of the pliers 100 (e.g., the resistance to torque induced when grabbing an object). The flanges 220, 320, and 1020 extend substantially perpendicular to the corresponding plates (e.g., parallel to the axis 120). The flanges 220, 320, and 1020 all extend toward a central plane of the pliers 100. The flange 220 of the main jaw plate 152 and the flange 320 of the secondary jaw plate 184 extend toward one another. The flange 320 of the secondary jaw plate 154 and the flange 1020 of the main jaw plate 182 extend toward one another. The flanges 220, 320, and 1020 all at least partially overhang (e.g., extend directly over, etc.) the closest inner layer. The flange 220 of the main jaw plate 152 overhangs the secondary jaw plate 164. The flange 320 of the secondary jaw plate 184 overhangs the main jaw plate 172. The flange 320 of the secondary jaw plate 154 overhangs the main jaw plate 162. The flange 1020 of the main jaw plate 182 overhangs the secondary jaw plate 174.

In some embodiments, the outer layers are made from a different material than the inner layers. In some embodiments, the outer layers are easier to bend (e.g., thinner, made from a softer material, etc.) than the inner layers. This may facilitate forming the flanges. In some embodiments, the inner layers are harder than the outer layers. This may facilitate maintaining a sharp edge on the blade 560 and the blade 860.

Using the foregoing design and structural features, multi-tools 10 can be created with a reinforced pliers 100 that are both stronger and easier to manufacture than traditional pliers. Forming the jaws 102, 104 from a series of plates (e.g., layers 150, 160, 170, 180) rather than molded or cast parts improves the manufacturability of the jaws 102, 104 and pliers 100, and allows for tighter tolerances and more consistent production. The layers 150, 160, 170, 180 can be formed of plate steel, for example, which is readily laser cut or otherwise formed into the jaws 102, 104. By creating the jaws 102, 104 in this manner, other types of finishing processes (e.g., deburring, polishing, etc.) are unnecessary, and can be eliminated from the multi-tool production process. By avoiding time-consuming finishing processes, the multi-tool 10 can be produced faster and cheaper than other conventional multi-tools. The sandwich-style plate design of the jaws 102, 104 greatly improves jaw torque strength and rigidity while also improving the crush force strength that can be transmitted through the multi-tool 10.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the multi-function tool as shown in the various exemplary embodiments is illustrative only. Additionally, any element disclosed in one embodiment may be incorporated or utilized with any other embodiment disclosed herein.

What is claimed is:

1. A multi-purpose tool, comprising:

a first handle;

a second handle; and a laminated plier jaw assembly coupled to the first handle and the second handle, the laminated plier jaw assembly comprising:

a first outer layer defining a first aperture;

a second outer layer defining a second aperture;

an inner layer positioned between and coupled to the first outer layer and the second outer layer, the inner layer defining a slot having a narrow portion positioned between a first wide portion and a second wide portion; and a pin extending at least partially through the first aperture, the second aperture, and the slot, wherein the first aperture of the first outer layer is oval shaped and configured to allow the pin to translate along a length of the first aperture and the second aperture is configured to prevent translation of the pin within the second aperture;

wherein the first outer layer, the second outer layer, and the inner layer cooperate to define a pair of jaws that rotate relative to one another about an axis of rotation, wherein the jaws are selectively reconfigurable between a small jaw spacing configuration where the pin extends through the first wide portion of the slot and a large jaw spacing configuration where the pin extends through the second wide portion of the slot; and wherein the first outer layer includes a flange extending toward the second outer layer, and wherein the flange at least partially overhangs the inner layer.

2. The multi-purpose tool of claim 1, wherein the pin includes a flattened section defining a pair of flat surfaces, wherein the pin is configured to pass through the narrow portion when the flat surfaces are aligned with the narrow portion, and wherein the pin is prevented from passing through the narrow portion when the flat surfaces are not aligned with the narrow portion.

3. The multi-purpose tool of claim 2, wherein the first aperture is a slot, wherein the pin is configured to both (a) rotate relative to the slot and (b) translate along a length of the slot.

4. The multi-purpose tool of claim 3, wherein the pin includes a fixed section extending at least partially through the second aperture, and wherein the fixed section and the second aperture are correspondingly shaped to limit rotation of the pin relative to the second aperture about the axis of rotation.

5. The multi-purpose tool of claim 4, wherein the inner layer is a first inner layer, wherein the laminated plier jaw assembly further includes a second inner layer positioned between and coupled to the first outer layer and the second outer layer, wherein the second inner layer defines a third aperture, and wherein the pin extends at least partially through the third aperture.

6. The multi-purpose tool of claim 5, wherein the flattened section of the pin extends at least partially through the third aperture, and wherein the third aperture and the flattened section are correspondingly shaped to limit rotation of the pin relative to the second aperture about the axis of rotation.

7. The multi-purpose tool of claim 6, wherein the laminated plier jaw assembly further comprises at least one third outer layer positioned outside of the first outer layer and the second outer layer.

8. The multi-purpose tool of claim 6, wherein the laminated plier jaw assembly further comprises at least one third inner layer positioned between the first outer layer and the second outer layer.

9. A laminated plier jaw assembly, comprising:

a first jaw including a first jaw plate and a second jaw plate fixedly coupled to one another;

a second jaw including a third jaw plate and a fourth jaw plate fixedly coupled to one another, the third jaw plate and the fourth jaw plate each defining a slot; and a pin fixedly coupled to the first jaw plate and extending through the slots to pivotally couple the jaws to one another, wherein the third jaw plate is positioned between the first jaw plate and the second jaw plate, and wherein the second jaw plate is positioned between the third jaw plate and the fourth jaw plate;

wherein the first jaw plate includes a first main jaw plate and a first secondary jaw plate, the first secondary jaw plate being fixedly coupled to the third jaw plate, and wherein the first main jaw plate defines a first plurality of teeth and the first secondary jaw plate defines a second plurality of teeth, the first plurality of teeth extending toward the first secondary jaw plate and the second plurality of teeth extending toward the first main jaw plate;

wherein the first secondary jaw plate is further defined by a flange extending away from the first secondary jaw plate and at least partially surrounding an outer surface of the third jaw plate; and wherein the third jaw plate includes a third main jaw plate and a third secondary jaw plate, the third secondary jaw plate being fixedly coupled to and positioned between the first main jaw plate and the second jaw plate, and wherein the first jaw plate is further defined by a second flange, the second flange extending away from the first jaw plate and at least partially surrounding an outer surface of the third secondary jaw plate.

10. The laminated plier jaw assembly of claim 9, wherein the first secondary jaw plate is formed from a first material and the third jaw plate is formed from a second material, and wherein a hardness of the first material is less than a hardness of the second material.

11. The laminated plier jaw assembly of claim 9, wherein the fourth jaw plate includes a fourth main jaw plate and a fourth secondary jaw plate, the fourth secondary jaw plate being fixedly coupled to the second jaw plate, and wherein a third flange extends away from the fourth main jaw plate and wherein a fourth flange extends away from the fourth secondary jaw plate, the third flange at least partially surrounding an outer surface of the second jaw plate and the fourth flange at least partially surrounding the outer surface of the second jaw plate.

12. A plier jaw assembly, comprising:

a first laminated jaw, comprising:

a first plate defining a gripping profile; and a second plate fixedly coupled to the first plate, the second plate including a flange at least partially overhanging the first plate; and a second jaw pivotally coupled to the first laminated jaw, wherein the first laminated jaw and the second jaw are selectively repositionable relative to one another between a fully open position and a fully closed position;

wherein the first plate is an inner plate, the flange is a first flange, and the second plate is a first outer plate, wherein the first laminated jaw further comprises a second outer plate fixedly coupled to the first outer plate, wherein the inner plate is positioned between the first outer plate and the second outer plate, and wherein the second outer plate includes a second flange extending toward the first flange; and wherein the first laminated jaw is slidably and rotatably coupled to the second jaw, and wherein the first laminated jaw is configured such that the first laminated jaw can slide relative to the second jaw only when the first laminated jaw is oriented within a threshold range of angular positions relative to the second jaw, the threshold range of angular positions being less than 360 degrees.

13. The plier jaw assembly of claim 12, wherein the inner plate is a first inner plate, wherein the first laminated jaw further comprises a second inner plate fixedly coupled to the first inner plate, wherein the second inner plate is positioned between the first outer plate and the second outer plate, and wherein the second flange at least partially overlaps the second inner plate.

14. The plier jaw assembly of claim 12, wherein the inner plate defines a first blade, wherein the second jaw defines a second blade, and wherein the first blade and the second blade are positioned adjacent one another when the first laminated jaw and the second jaw are in the fully closed position.

15. A laminated plier jaw assembly, comprising:

a first jaw including a first jaw plate and a second jaw plate fixedly coupled to one another;

a second jaw including a third jaw plate and a fourth jaw plate fixedly coupled to one another, the third jaw plate and the fourth jaw plate each defining a slot; and a pin fixedly coupled to the first jaw plate and extending through the slots to pivotally couple the jaws to one another, wherein the third jaw plate is positioned between the first jaw plate and the second jaw plate, and wherein the second jaw plate is positioned between the third jaw plate and the fourth jaw plate;

wherein the first jaw plate includes a first main jaw plate and a first secondary jaw plate, the first secondary jaw plate being fixedly coupled to the third jaw plate, and wherein the first main jaw plate defines a first plurality of teeth and the first secondary jaw plate defines a second plurality of teeth, the first plurality of teeth extending toward the first secondary jaw plate and the second plurality of teeth extending toward the first main jaw plate;

wherein the first secondary jaw plate is further defined by a flange extending away from the first secondary jaw plate and at least partially surrounding an outer surface of the third jaw plate; and wherein the first secondary jaw plate is formed from a first material and the third jaw plate is formed from a second material, and wherein a hardness of the first material is less than a hardness of the second material.

* * * * *